United States Patent [19]

Uttscheid

[11] Patent Number: 4,641,582

[45] Date of Patent: Feb. 10, 1987

[54] ELECTRIC OVERHEAD TROLLEY CONVEYOR

[76] Inventor: Georg Uttscheid, Madronstrasse 17,, D- 8201 Rosenheim, Fed. Rep. of Germany

[21] Appl. No.: 732,510

[22] Filed: May 9, 1985

[30] Foreign Application Priority Data

May 21, 1984 [DE] Fed. Rep. of Germany ..... 3418866

[51] Int. Cl.[4] ..... B61B 3/02; E01B 25/22

[52] U.S. Cl. ..... 104/93; 105/150; 191/45 A

[58] Field of Search ..... 104/89, 93, 95; 105/148, 150, 154; 191/45 A

[56] References Cited

U.S. PATENT DOCUMENTS 2,728,819 12/1955 Hauss ..... 191/45 A X
3,604,434 9/1971 Hurst ..... 104/93 X
3,855,941 12/1974 Fromme et al. ..... 105/150

FOREIGN PATENT DOCUMENTS 2343263 3/1975 Fed. Rep. of Germany ..... 105/150
2545907 4/1977 Fed. Rep. of Germany .
2750453 5/1979 Fed. Rep. of Germany .
1407325 6/1965 France ..... 191/45 A

*Primary Examiner*—Robert B. Reeves
*Assistant Examiner*—David F. Hubbuch
*Attorney, Agent, or Firm*—Cahill, Sutton & Thomas

[57] ABSTRACT

A lower chord electric trolley conveyor comprising a rail with an upper flange which is directly connected to a support structure. The electric trolley receives its current from a bus bar attached to the rail. The drive wheels of the trolley engage the upper side of the lower flange of the rail. Upper flanges extend from a vertical web of the rail toward both sides while a lower flange extends only toward one side. The electric trolley wraps around the lower part of the rail. It comprises counter pressure rolls in front of and behind the drive wheel. The counter pressure rolls engage the surface of the upper flange which faces the lower flange. Several support rolls engage both sides of the vertical web of the rail. The bus bar is connected to the side of the vertical web of the rail facing away from the drive wheel.

3 Claims, 2 Drawing Figures

ELECTRIC OVERHEAD TROLLEY CONVEYOR

TECHNICAL FIELD

The invention relates to an electric overhead trolley conveyor with a rail, which is directly connected with the upper flange to a supporting structure. Further, the electric overhead trolley conveyor comprises electric trolleys which receive electric current from a bus bar connected to the rail. The drive wheels of the electric trolley run on the upper side of the lower flange of the rail.

BACKGROUND ART

Usually, in such an electric trolley conveyor the rail has a double-T cross section and the electric trolleys engage the lower flange with two drive wheels at both sides of the middle web of the rail. With such a type of an electric trolley conveyor the goal of small overall height of the electric trolleys cannot be fully satisfied.

As long as such an electric trolley conveyor is only designed for horizontal movement, the demands on the guidance by the rail are not very critical. However, if the trolley conveyor is also to be operated with inclining and declining rail sections, such sections must be provided with sprocket chains or racks which cooperate with a sprocket wheel or a pinion, which in turn is mounted coaxially with the drive wheel and driven jointly with the drive wheel. Counter pressure rollers are necessary in order to secure a sufficient engagement between the sprocket wheel or the pinion and the chain or rack, respectively, especially if the inclining and declining rail sections are steep. The counter pressure rolls must engage the rail in such a fashion, that the drive wheels are always pressed against the corresponding surface of the rail. Further, lateral support rolls are generally necessary. With trolleys of this kind the positioning of the bus bars and of the associated electric supply cables is difficult.

For this reason, the electric trolleys are usually built as upper chord trolleys as shown for example in German patent application 25 45 907, even though this imparts a greater height to the electric trolleys. In this case the drive wheels engage the upper surface of the upper flange or the upper chord of the rail while the counter pressure rolls engage the lower surface of the lower flange or chord of the rail. Therefore, the rail must be connected to the support structure through rigid brackets. Further, it is known to use lower chord electric trolleys in conjunction with a rail with an upright U-cross section which opens toward the side. In this case the drive wheel engages the upper surface of the lower chord while the counter pressure rolls engage the lower surface of the upper chord. The electric trolley is wrapped around the upper side of the rail so that lateral support rolls can engage the side of the vertical web of the rail facing away from the drive wheel. Again, brackets for supporting the rail are necessary. Further, the bus bar must be connected with the lower side of the lower flange so that the free movement of the electric trolleys is not hindered by the power supply cables. This requires an additional increase of the overall height of the trolleys (German patent application 27 50 453).

DISCLOSURE OF INVENTION

Therefore, it is the object of the present invention to provide an electric trolley conveyor, whereby the rail is directly attached to the support structure and whereby the electric trolleys have an extremely low overall height and a simple structure while the guiding and driving of the trolleys is without problems even in inclining and declining rail sections and whereby further the positioning of the bus bar is neither problematic in terms of the height of the electric trolleys nor in terms of the free movability of the electric trolleys.

The invention utilizes a rail having a lower flange extending to but one side of the vertical web of the rail. The electric trolley has a drive wheel which engages the upper surface of the lower flange of the rail. Counter pressure rolls also carried by the trolley engage the under surface of an upper flange on the rail and urge the drive wheel into engagement with the lower rail. The trolley wraps around the lower part of the rail and carries support rolls which engage opposite faces of the web of the rail in a lower region of the web. This leaves space on the rail on the side of the web opposite the drive wheel of the trolley to position a bus bar to carry electrical current to the trolley.

BRIEF DESCRIPTION OF THE DRAWINGS

The invention shall now be explained with reference to drawings which show a preferred embodiment.

BEST MODE FOR CARRYING OUT THE INVENTION

Figure 1:
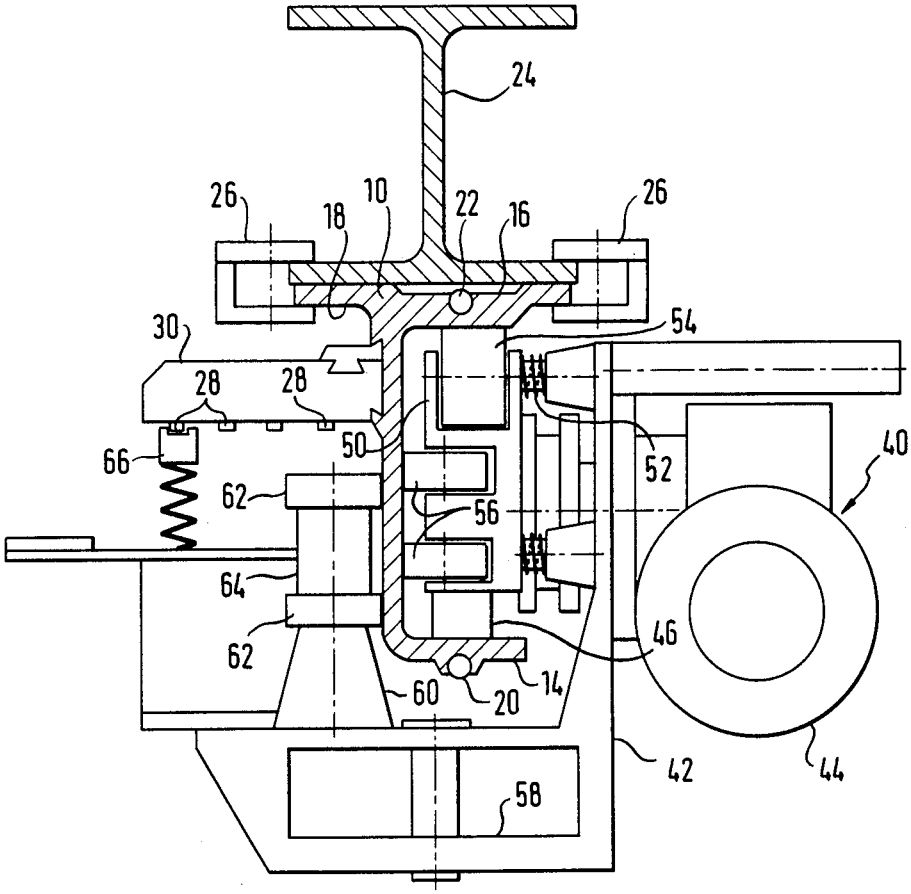
FIG. 1 shows a cross-section of the electric trolley conveyor of the present invention, whereby the rail and the support structure are shown in cross-section, while the electric trolley is shown in front elevation.
Figure 2:
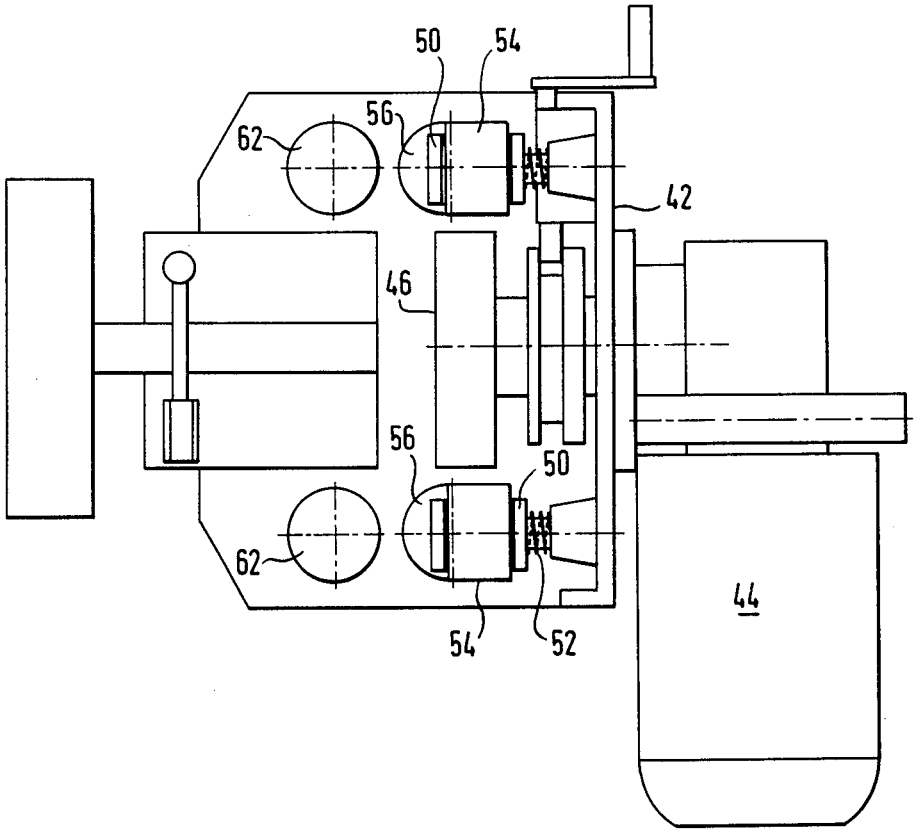
FIG. 2 shows a top view of the electric trolley of FIG. 1.

FIG. 1 shows a rail 10 for the lower chord electric trolley conveyor of the invention. This rail comprises a vertical web 12. From its lower end a lower flange, or a lower chord, 14 extends toward one side (in FIG. 1 toward the right side). From the upper end of the vertical web 12 two upper flanges, or upper chords, 16 and 18 extend outwardly from both sides. The upper flange 16 extending toward the same side as the lower flange 14 has a greater lateral extension than the other upper flange 18. Further, the part of the upper flange 16 facing the lower flange 14 is thicker than the other parts of the upper flange 16. The lower side of the upper flange 16 and the upper side of the lower flange 14 serve as running surfaces. Centering pins 20, 22 are provided at the lower flange 14 and at the upper flange 16 for securing the proper alignment of the rail sections. A support structure 24 is shown as a double-T beam. It directly supports the guide rail by means of clamps 26. Alternatively, other connection means such as nuts and bolts may be used. Also, an attachment to an already existent circular conveyor is possible. Bus bars 28 are connected by means of brackets 30 to the upper area of the side of the vertical web 12 of the rail 10 facing away from the lower flange 14. The power supply cables leading to the bus bars 28 are not shown.

An electric trolley is generally indicated with the reference numeral 40. It wraps around the lower part of the rail 10. The electric trolley 40 comprises a housing 42. This housing carries a geared motor 44 which drives a drive wheel 46 as well as a sprocket wheel which is not shown and which is mounted concentrically to the drive wheel 46. The sprocket wheel cooperates with chain sections not shown. The drive wheel is designed as a slip wheel. Details of such a drive wheel and of the sprocket drive are shown in German patent applications 31 28 824.3 and 34 03 460.9. Explicit reference is made to these publications for the purpose of disclosure.

The drive wheel 46 engages the upper side of the lower flange 14 of the rail 10. Before and behind the drive wheel 46 a roll mounting block 50 is mounted under bias by means of springs 52 at the housing 42. Each roll mounting block 50 carries a counter pressure roll 54, which engages the lower side of the upper flange 16. Further, the roll mounting block 50 carries two support rolls 56, which engage the side of the vertical web 12 of the rail 10 facing the drive wheel 46. Below the rail 10 the housing 42 comprises a device 58 for suspending the load and from this device 58 mounting blocks 60 extend upward at the side of the rail 10 facing away from the drive wheel 46. The mounting block 60 carries further support rolls 62 as well as a separation sleeve 64. The four support rolls 62 are positioned approximately opposite from the support rolls 56, i.e. they engage the side of the vertical web 12 of the rail 10 facing away from the drive wheel 46. The springs 52 push the support rolls 56 toward the support rolls 62 so that all support rolls are always in engagement with the vertical web 12 of the rail 10. The bus bars 28 are positioned above the support rolls 62. The electric trolley 40 comprises a current collector 66, which extends upwardly between the two pairs of support rolls 62.

The lower chord electric trolley conveyor according to the present invention shows an extremely compact structure with a very low height. In spite of the unsymmetric structure, whereby the drive means for the horizontal movement as well as for the movement through inclining and declining rail sections are located at one side of the rail 10 while the bus bar is located at the other side of the rail 10, the trolley operates without any troubles. It moves through all rail sections whether horizontal or inclined without free play so that a positive drive is ensured. The height of the trolley may be extremely low and notably less than 235 mm.

I claim:

1. A lower chord electric trolley conveyor comprising a rail having a vertical web and upper and lower flanges extending therefrom, said upper flange being directly connected to a support structure, and an electric trolley having a drive wheel engaging the upper surface of the lower flange of the rail and receiving current from a bus bar carried by the rail, characterized in that said upper flange extends from the vertical web of the rail from both sides while the lower flange extends only from one side, that the electric trolley wraps around the lower part of the rail and includes counter pressure rolls preceding and following the drive wheel in relation to the direction of movement of the trolley, said counter pressure rolls engaging the surface of the upper flange facing the lower flange, that support rolls carried by the trolley engage both sides of the vertical web of the rail, and that the bus bar is attached to the side of the vertical web of the rail facing away from the drive wheel.

2. Trolley conveyor according to claim 1, characterized in that preceding and following the drive wheel there is provided a roll support block, each of said blocks supporting a counter pressure roll and two support rolls, and said trolley further includes spring means pushing said blocks toward the vertical web of the rail.

3. Trolley conveyor according to one of claims 1 or 2, characterized in that the bus bar is provided above the support rolls at the side of the rail facing away from the drive wheel.

* * * * *